US007624956B2

(12) United States Patent
Steigert et al.

(10) Patent No.: US 7,624,956 B2
(45) Date of Patent: Dec. 1, 2009

(54) DEVICES FOR FASTENING AN EXHAUST MANIFOLD TO AN INTERNAL COMBUSTION ENGINE

(75) Inventors: Andreas Steigert, Lambrecht (DE); Lan Huynh, Neustadt (DE); Steffen Kauffmann, Hanhofen (DE)

(73) Assignee: Heinrich Gillet GmbH, Edenkoben (DE)

( * ) Notice: Subject to any disclaimer, the term of this patent is extended or adjusted under 35 U.S.C. 154(b) by 98 days.

(21) Appl. No.: 11/798,169

(22) Filed: May 10, 2007

(65) Prior Publication Data

US 2007/0262222 A1 Nov. 15, 2007

(30) Foreign Application Priority Data

May 10, 2006 (DE) ..... 20 2006 007 437

(51) Int. Cl.
*F16M 11/00* (2006.01)

(52) U.S. Cl. ..... 248/201; 248/110; 248/111; 248/113; 180/309

(58) Field of Classification Search ..... 248/201, 248/110, 111, 113; 180/309
See application file for complete search history.

(56) References Cited

U.S. PATENT DOCUMENTS

| | | | | |
|---|---|---|---|---|
| 1,154,817 | A * | 9/1915 | De Vore | 152/334.1 |
| 1,371,622 | A * | 3/1921 | Hudson | 248/675 |
| 1,635,847 | A * | 7/1927 | Hooper | 248/675 |
| 5,369,952 | A * | 12/1994 | Walters | 60/796 |
| 2001/0032909 | A1 * | 10/2001 | Goettle | 248/58 |
| 2008/0067303 | A1 * | 3/2008 | Compagnucci | 248/201 |

* cited by examiner

*Primary Examiner*—J. Allen Shriver, II
*Assistant Examiner*—Nkeisha J Smith
(74) *Attorney, Agent, or Firm*—Muncy, Geissler, Olds & Lowe, PLLC

(57) ABSTRACT

A device for fastening an exhaust manifold to an internal combustion engine is provided. The device includes two parts. A first part that has first elongated holes for a screw fastening to the engine and openings for a screw fastening of a second bracket part. The second bracket part is fork-shaped, angular, and has on the angle branch facing the first bracket part second elongated holes and on the other angle branch, third elongated holes. The longitudinal axes of at least two of the elongated holes are oriented perpendicular to one another.

7 Claims, 1 Drawing Sheet

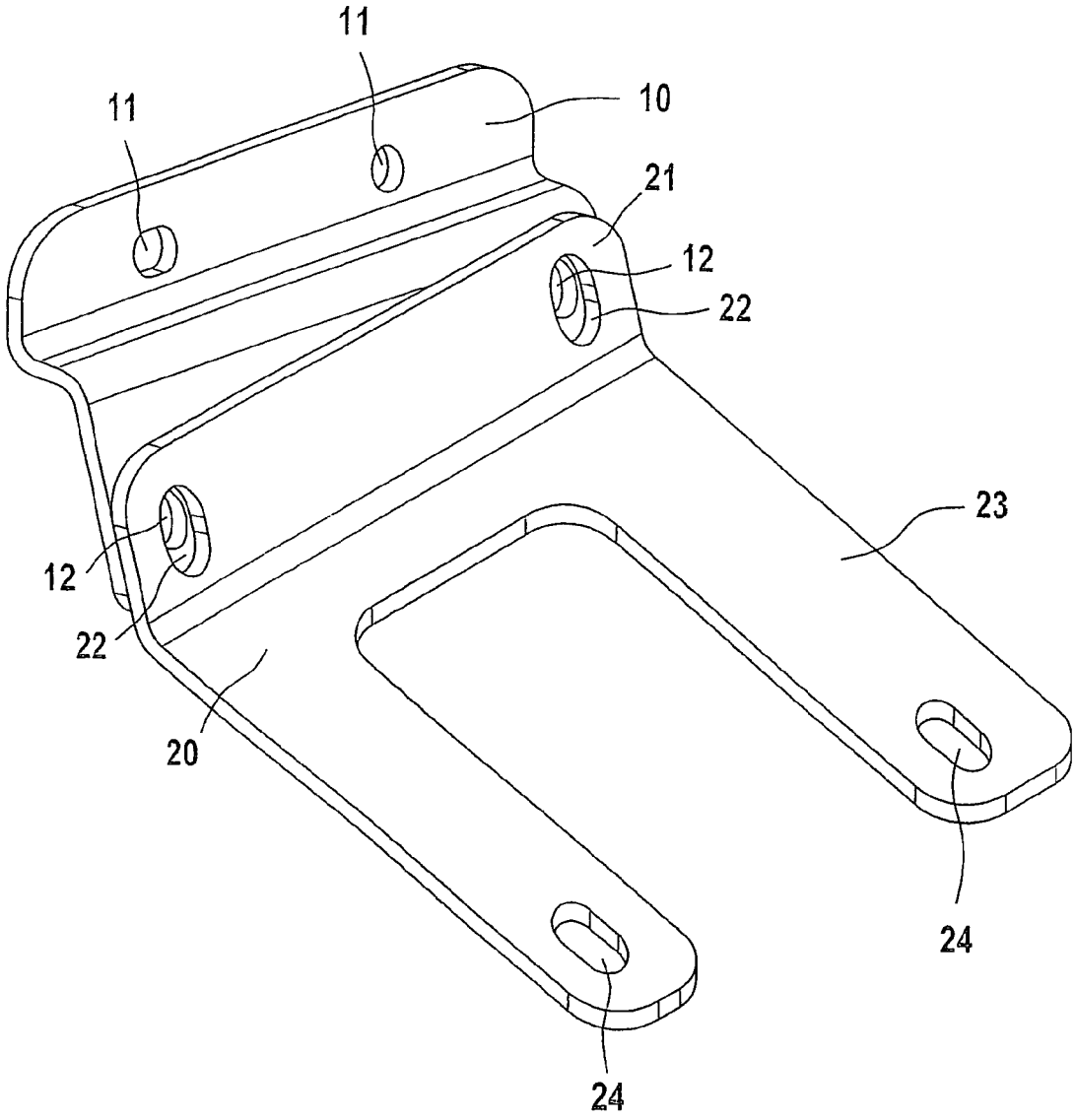
11
11
10
21
12
22
23
12
22
20
24
24

DEVICES FOR FASTENING AN EXHAUST MANIFOLD TO AN INTERNAL COMBUSTION ENGINE

This non provisional application claims priority under 35 U.S.C. §119(a) to German Patent Application No. DE 20 2006 007 437.6, which was filed in Germany on May 10, 2006, and which is herein incorporated by reference.

BACKGROUND OF THE INVENTION

1. Field of the Invention

The present invention relates to devices for fastening an exhaust manifold to an internal combustion engine.

2. Description of the Background Art

In the fastening of an exhaust manifold to an engine block, it is noticed that considerable component and dimensional tolerances occur. Since individual selection is not possible during belt assembly, the components are installed with tensile or compressive stress, depending on the tolerance situation. This not only makes installation more difficult, but also reduces the long-term stability. This is unsatisfactory.

SUMMARY OF THE INVENTION

It is an object of the present invention to provide a fastening device that permits assembly without harmful stresses.

This goal is accomplished via a device that includes a first bracket part that has initial elongated holes for screw fastening to the engine block and openings for screw fastening of a second bracket part, a second bracket part that is fork shaped, is angular, and has second elongated holes on the angle branch facing the first bracket part, and on the other angle branch, third elongated holes the longitudinal axes of at least two of the elongated holes are oriented perpendicular to one another.

The fastening device in accordance with the invention is characterized by particular simplicity in conjunction with optimal adjustability. It includes only two parts and nevertheless permits adjustment in up to three spatial planes.

Advantageously, the first bracket part is offset in a stepwise manner. As a result, a free space occurs, which can be used especially for the screw fastening of the second bracket part.

To make a screw connection possible, the openings in the first bracket part can be designed as threaded holes. Alternatively, the use of weld nuts is possible.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawing which are given by way of illustration only, and thus, are not limitive of the present invention, and wherein the FIGURE shows a device according to an embodiment of the present invention.

DETAILED DESCRIPTION

The FIGURE shows a device for fastening an exhaust manifold to the block of an internal combustion engine (not shown). A first bracket part 10 is recognizable. This has, at the top, a first series of fastening holes 11, at least one of which is designed as an elongated hole. The longitudinal axis of this elongated hole 11 is made to be horizontal.

The first bracket part 10 is offset in a stepwise manner, so that following the offset part, space is formed for screws or nuts. The offset bracket part 10 has two fastening openings 12. These can be designed as threaded holes. Alternatively, a weld nut may be positioned after each of the openings 12.

To the first bracket part 10, a second bracket part 20 can be screwed on. This is made in a fork shape and curved at approximately a right angle. On the first angle branch 21, two fastening openings 22 are formed as elongated holes. The longitudinal axis of these elongated holes 22 travels perpendicular to the longitudinal axis of the first fastening openings 11.

On the second branch 23 of the second bracket part 20, additional fastening openings 24 are provided as elongated holes. The longitudinal axes of these elongated holes 24 are oriented perpendicular to the longitudinal axes of the elongated holes 11, 22. In addition, the second angular branch 23 is made in a fork shape, adapted to the exhaust manifold to be held (not shown).

The fastening of the holding device 10, 20 to the engine block, the fastening of the second bracket part 20 to the first bracket part 10, and the fastening of the exhaust manifold to the second bracket part 20 are accomplished with the aid of threaded screws. Thanks to the elongated holes 11, 22, 24, the holding device can always be adjusted in such a way that even in the case of large component and dimension tolerances, stress-free assembly is possible, which guarantees a long lifetime to the construction elements.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A device for fastening an exhaust manifold to an internal combustion engine, the device comprising:

a first bracket part having first elongated holes in a first portion thereof for screw fastening of said first bracket part to an engine block, a second bracket part having a U-shaped portion on one end thereof having spaced apart legs, and an end of said second bracket part opposite from said U-shaped portion extending in a first plane which is disposed at an angle to a second plane within which said U-shaped portion extends, and said opposite end of said second bracket having second elongated holes, and said U-shaped portion having third elongated holes, said first bracket part including a second portion having openings spaced from said first elongated holes for screw fastening of said second bracket part to said first bracket part, said second portion of said first bracket part extending in a different plane than said first portion of said first bracket part, said first portion of said first bracket and said second portion of said first bracket being connected by a third bracket portion extending in a plane offset from the planes in which said first and second portions extend such that said first bracket portion has a stepped configuration, wherein longitudinal axes of at least two of the first, second or third elongated holes are oriented perpendicular to one another.

2. The device according to claim 1, wherein said openings in said first bracket part are threaded.

3. The device according to claim 1, wherein nuts are welded on behind the openings in said first bracket part.

4. The device according to claim 1, wherein said first and second planes of said second bracket part are perpendicular to each other.

5. The device according to claim 1, wherein a longitudinal axis of said second elongated holes and a longitudinal axis of said third elongated holes are perpendicular to each other.

6. The device according to claim 1, wherein said third elongated holes are located in each leg of said U-shaped portion of said second bracket part.

7. The device according to claim 1, wherein said openings of said first bracket part and said second elongated holes of said second bracket part are of such dimension and are so positioned on said respective first and second bracket parts to permit attachment of said first and second bracket parts together.

* * * * *